US006302339B1

(12) United States Patent
Chou

(10) Patent No.: US 6,302,339 B1
(45) Date of Patent: Oct. 16, 2001

(54) CONTINUOUSLY ADJUSTABLE WATER FLOW CONTROL APPARATUS

(76) Inventor: Hsiao-Tsung Chou, 4-2 Fl, No. 2, 43 Lane, Chung-Hwa Rd., Sanhsia Town, Taipei Hsien (TW)

( * ) Notice: Subject to any disclaimer, the term of this patent is extended or adjusted under 35 U.S.C. 154(b) by 0 days.

(21) Appl. No.: 09/692,441

(22) Filed: Oct. 20, 2000

(51) Int. Cl.[7] ..... B05B 1/30

(52) U.S. Cl. ..... 239/581.2; 239/548; 239/443; 239/446; 239/451; 239/456; 239/457; 239/569; 239/579

(58) Field of Search ..... 239/548, 436, 239/437, 438, 443, 446, 451, 453, 456, 457, 458, 569, 579, 581.2

(56) References Cited

U.S. PATENT DOCUMENTS 641,933 * 1/1900 Canner ..... 239/456 X
835,612 * 11/1906 Hartwell ..... 239/443 X
922,895 * 5/1909 Helm ..... 239/443 X
1,013,043 * 12/1911 Mueller et al. ..... 239/456 X
2,556,537 * 6/1951 Harvey ..... 239/458 X
2,949,242 * 8/1960 Blumberg et al. ..... 239/451 X
4,657,185 * 4/1987 Rundzaitis ..... 239/438

* cited by examiner

*Primary Examiner*—David A. Scherbel
*Assistant Examiner*—Robin O. Evans
(74) *Attorney, Agent, or Firm*—Bacon & Thomas PLLC

(57) ABSTRACT

A continuously adjustable water flow control apparatus includes at least a control seat, a adjustment head, a push sleeve and an adjustment cap. A relative position between the adjusting plate and the push sleeve can be changed by adjusting the adjustment cap to press against the adjusting plate of the adjustment head. Accordingly, a stepless change of the sectional figure and area of the water channel is attainable. In addition, the use of the continuously adjustable water flow control apparatus in combination with different kinds of shower heads and rotational devices will meet different needs of the users.

6 Claims, 10 Drawing Sheets

CONTINUOUSLY ADJUSTABLE WATER FLOW CONTROL APPARATUS

BACKGROUND OF THE INVENTION

1. Field of the Invention

The present invention relates to a continuously adjustable water flow control apparatus, and more particularly, to a device in which a relative position between an adjusting plate and a push sleeve can be changed by adjusting an adjustment cap to press against the adjusting plate of the adjustment head. Accordingly, a stepless change of the sectional figure and area of the water channel is attainable. In addition, the use of the continuously adjustable water flow control apparatus in combination with different kinds of shower heads and rotational devices will meet different needs of the users.

2. Description of the Prior Art

The conventional water flow control device is fitted with a water valve at the flow channel inside of the outlet to control the water flow. However, the design of this conventional device is aimed at the controlling methods (direct press control or indirect control) of all kinds of switches, outflow retaining function and outflow mode change (concentrated, dispersed spray etc.) in order to promote the using convenience.

However, the requirements of all kinds of instruments and daily necessities become more and more strict. Not only should it have basic functions with quality requirements, but also have various additional functions in order to broaden the application fields and to facilitate the application. Similarly, the structure of the outflow head (shower head) also applies thereto. Thus, how to make the shower head with more outflow modes in order to meet different requirements of promoting the using functions and broadening the application fields is a bottleneck for the related industry to make breakthrough.

SUMMARY OF THE INVENTION

It is a primary object of the present invention to provide a continuously adjustable water flow control apparatus, wherein a relative position between the adjusting plate and the push sleeve can be changed by adjusting the adjustment cap to press against the adjusting plate of the adjustment head. Accordingly, a stepless change of the sectional figure and area of the water channel is attainable.

It is a further object of the present invention to provide a continuously adjustable water flow control apparatus, wherein the use of the continuously adjustable water flow control apparatus in combination with different kinds of shower heads and rotational devices will meet different needs of the users.

BRIEF DESCRIPTION OF THE DRAWINGS

The drawings disclose illustrative embodiments of the present invention which serve to exemplify the various advantages and objects hereof, and are as follows.

DETAILED DESCRIPTION OF THE PREFERRED EMBODIMENT

Figure 1:
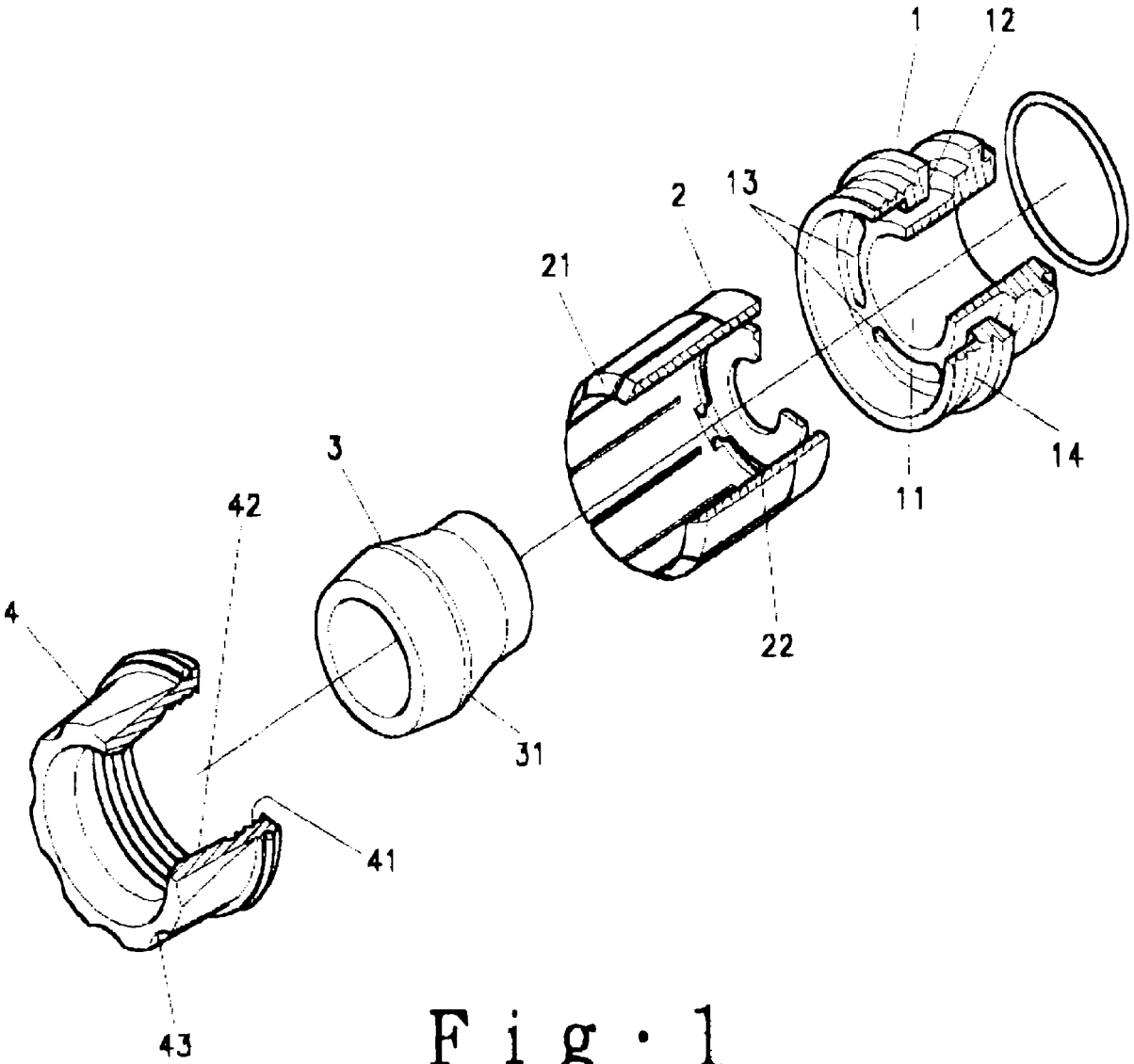
FIG. 1 is a perspective exploded view of the main control device of the present invention.

FIG. 1 shows a perspective exploded view of the main control device of the present invention. It is apparent from FIG. 1 that the continuously adjustable water flow control apparatus at least includes a control seat 1, an adjustment head 2, a push sleeve 3 and an adjustment cap 4. The control seat 1 is fitted with a male thread 14 at one end thereof, a step rim 12 at the center thereof and a partition inside thereof. The center of the partition contains a through hole 11 at the rim of which a plurality of channels 13 are disposed. The adjustment head 2 is cylinder-shaped, and the side wall of the opening end thereof is composed of adjusting plates 21 arranged in a ring-shaped manner and evenly spaced. The bottom thereof includes a through hole and channels 22 corresponding to that of the control seat 1. The push sleeve 3 is provided with a resilient ring 31 at a proper position of the side wall thereof. The adjustment cap 4 is fitted with a slope 42 at the inner rim thereof and a female thread 41 at one end thereof. In assembly, the adjustment head 2 is inserted into one end of the control seat 1 such that the channels 13, 22 are aligned opposite one another. Thereafter, the push sleeve 3 is installed in the adjusting plates 21 of the adjustment head 2 while the adjustment cap 4 and the control seat 1 are screwed together by means of the female thread 41 and the male thread 14. In turning the adjustment cap 4, the adjustment cap 4 is rotatively movable backwards and forwards at the outer rim of the control seat 1 while the slopes 42 at the inner rim thereof is pushed against the outer rim of the adjusting plates 21. As a result, a stepless change is created at the clearance of adjusting plates 21 and at the corresponding position of the push sleeve 3.

Figure 2:
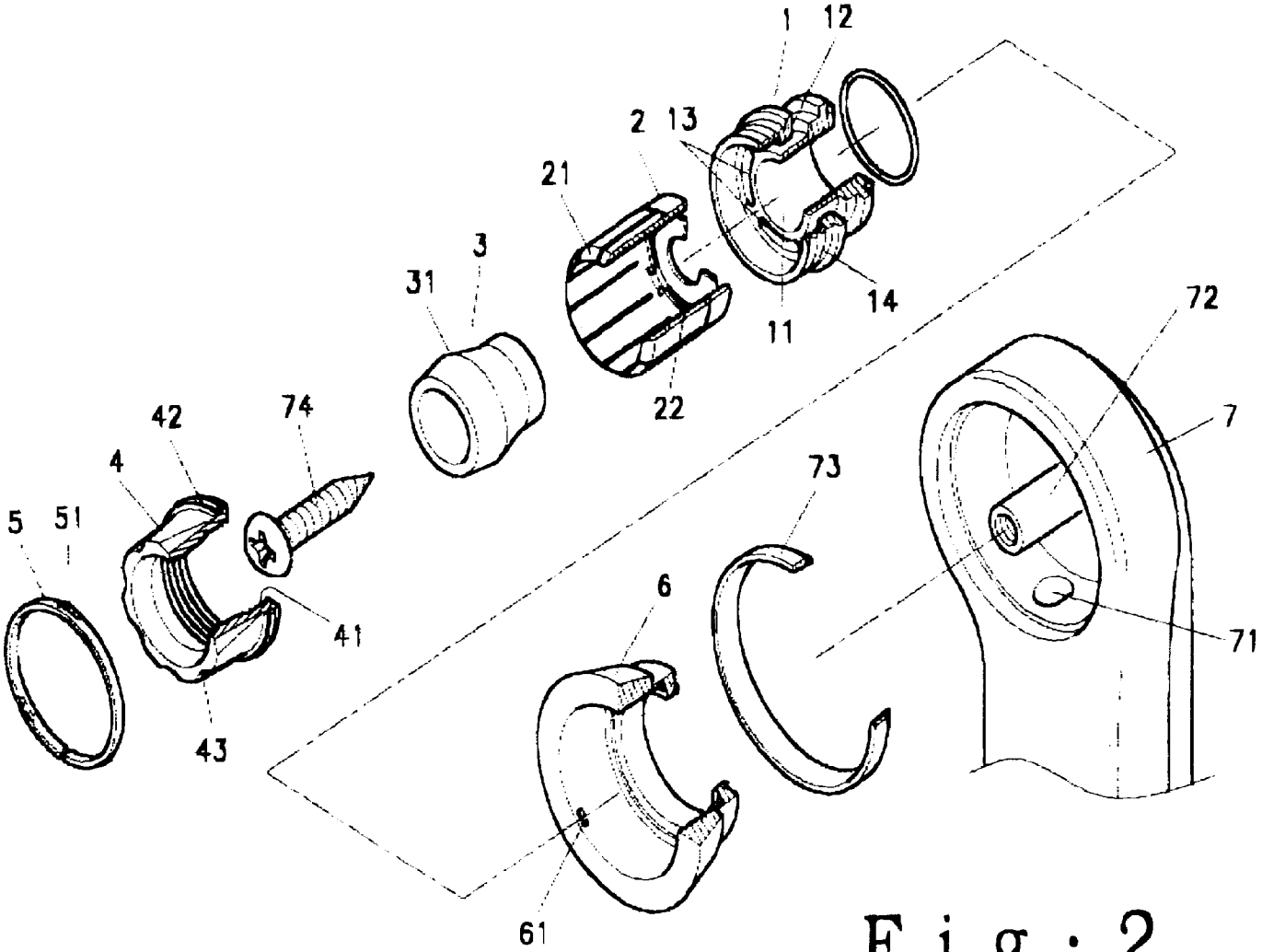
FIG. 2 is a perspective exploded view of a first preferred embodiment of the present invention.
Figure 2B:
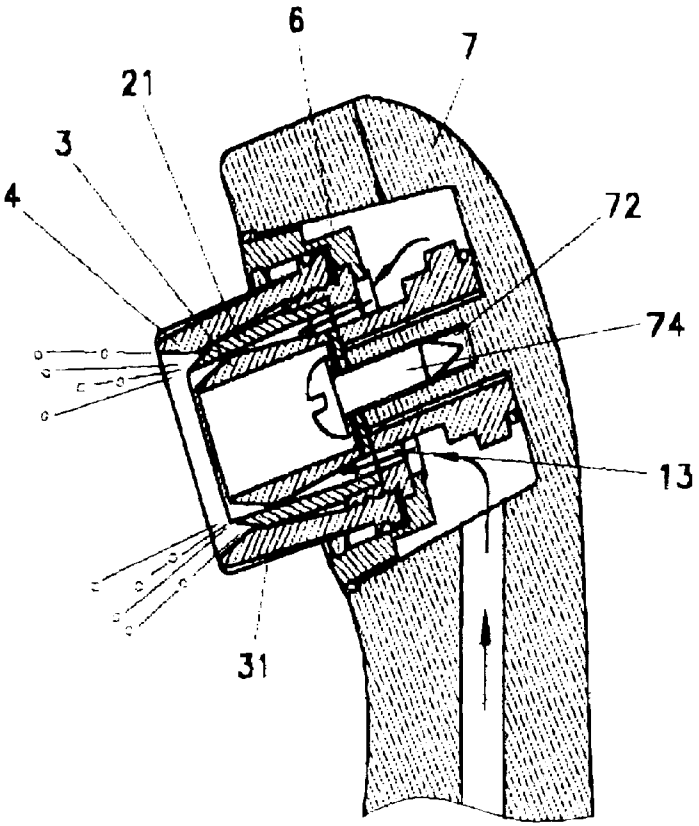
FIG. 2B is a second sectional view of the first preferred embodiment of the present invention showing the using state thereof.
Figure 2A:
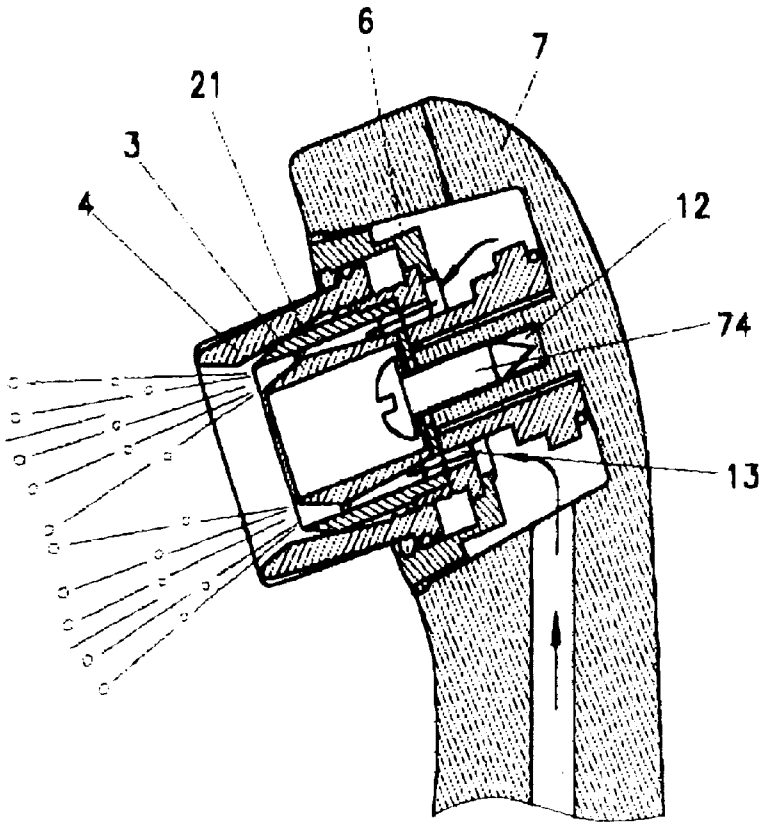
FIG. 2A is a first sectional view of the first preferred embodiment of the present invention showing the using state thereof.

FIG. 2 shows a perspective exploded view of a first preferred embodiment of the present invention. It's apparent from FIG. 2 together with FIGS. 2A and 2B that the above-mentioned control device together with an inner sleeve 6 is inserted into a shower head 7 and fixed by a screw 74 on a fixing shaft hole 72. And a blocking ring 5 is mounted at a proper position of the outer rim of the adjustment cap 4 while a key 51 is locked into a groove 61 of the inner sleeve 6. Accordingly, the water flows from the opening 71 through the channels 13, 22 to the clearance between the adjusting plates 21 and the push sleeve 3 for spraying outward. In turning the adjustment cap 4, a stepless change is created at the clearance of adjusting plates 21 and at the corresponding position of the push sleeve 3 so that a stepless control change will also apply to the sprayed water.

Figure 3:
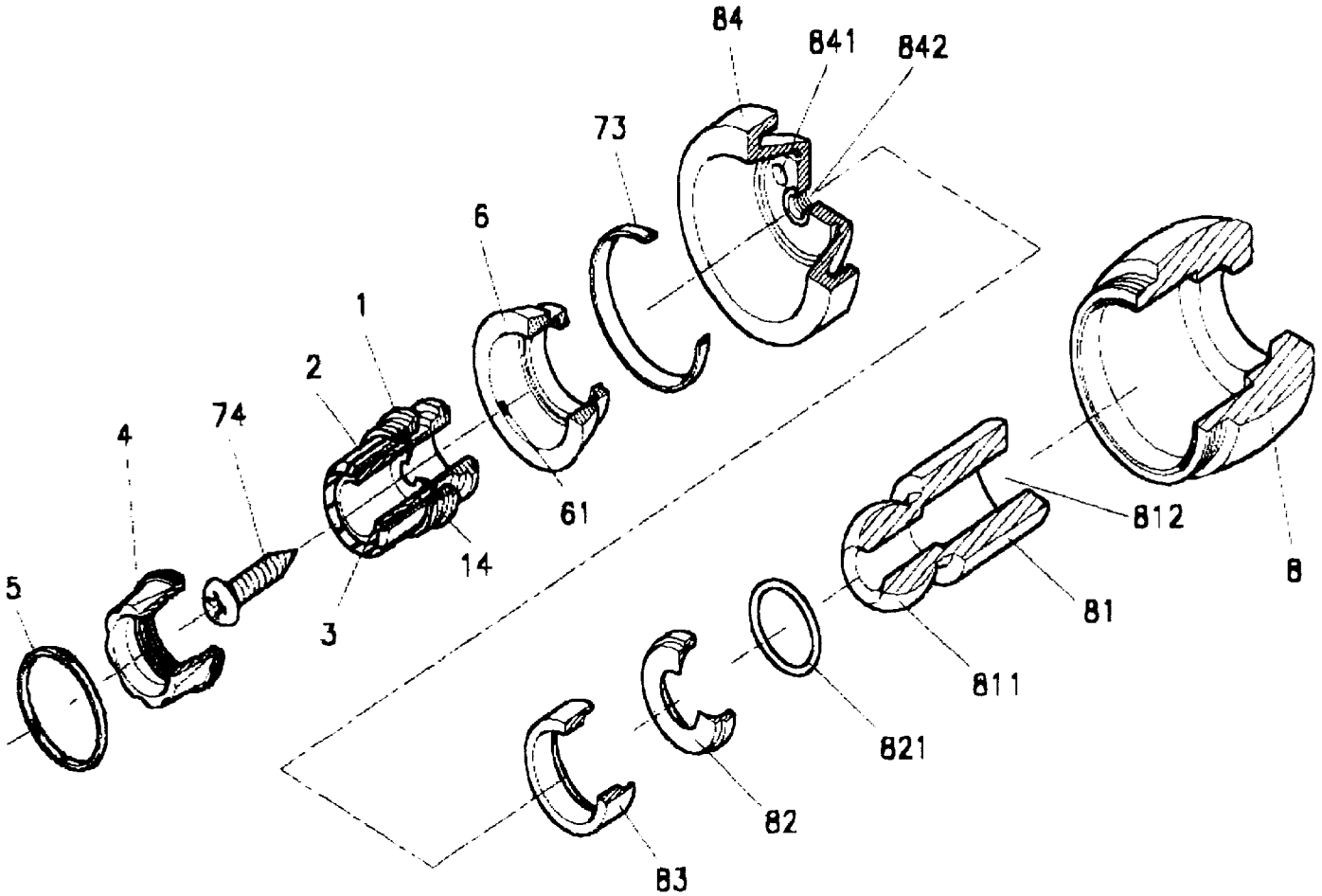
FIG. 3 is a perspective exploded view of a second preferred embodiment of the present invention.
Figure 3A:
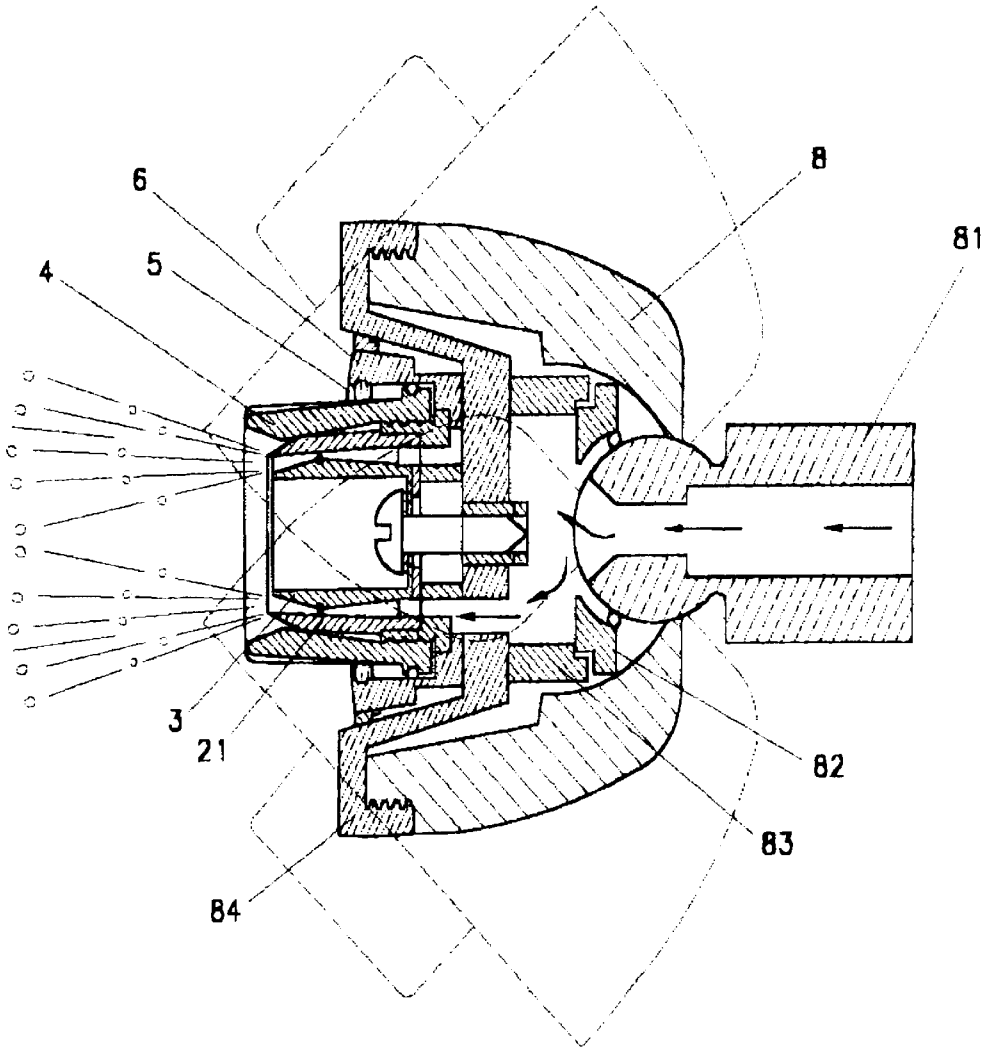
FIG. 3A is a sectional view of the second preferred embodiment of the present invention showing the using state thereof.

FIG. 3 shows a perspective exploded view of a second preferred embodiment of the present invention. It's apparent from FIG. 3 together with FIG. 3A that a rotational device secured with the control device consists of a housing 8, a rotational shaft 81, a joint seat 82, a push ring 83 and a fixing seat 84. The rotational shaft 81 is inserted into one end of the housing 8 such that a ball seat 811 is locked at the inner rim of the housing 8. Thereafter, the joint seat 82 and the push ring 83 are also installed while the fixing seat 84 is screwed at the other end of the housing 8 for creating a multi-directional base. A sealing ring 73 and the inner sleeve 6 are mounted at the opening of the base. Thereafter, the control seat 1 is placed into and screwed with the screw 74. The adjustment cap 4 and the control seat 1 are screwed together by means of the female thread 41 and the male thread 14. Again, the blocking ring 5 is inserted for creating the control device. The housing 8 is rotatable at the center of the ball seat 811 of the rotational shaft 81 for a multi-direction rotation to achieve a flexible change of the spraying direction. In turning the adjustment cap 4, the housing 8 is enabled for a forward and a backward movement. A stepless water flow change is created by means that the slope at inner rim thereof is pressed against the adjusting plates 21 of the adjustment head 2. Consequently, the spraying ways and directions are variable.

Figure 4:
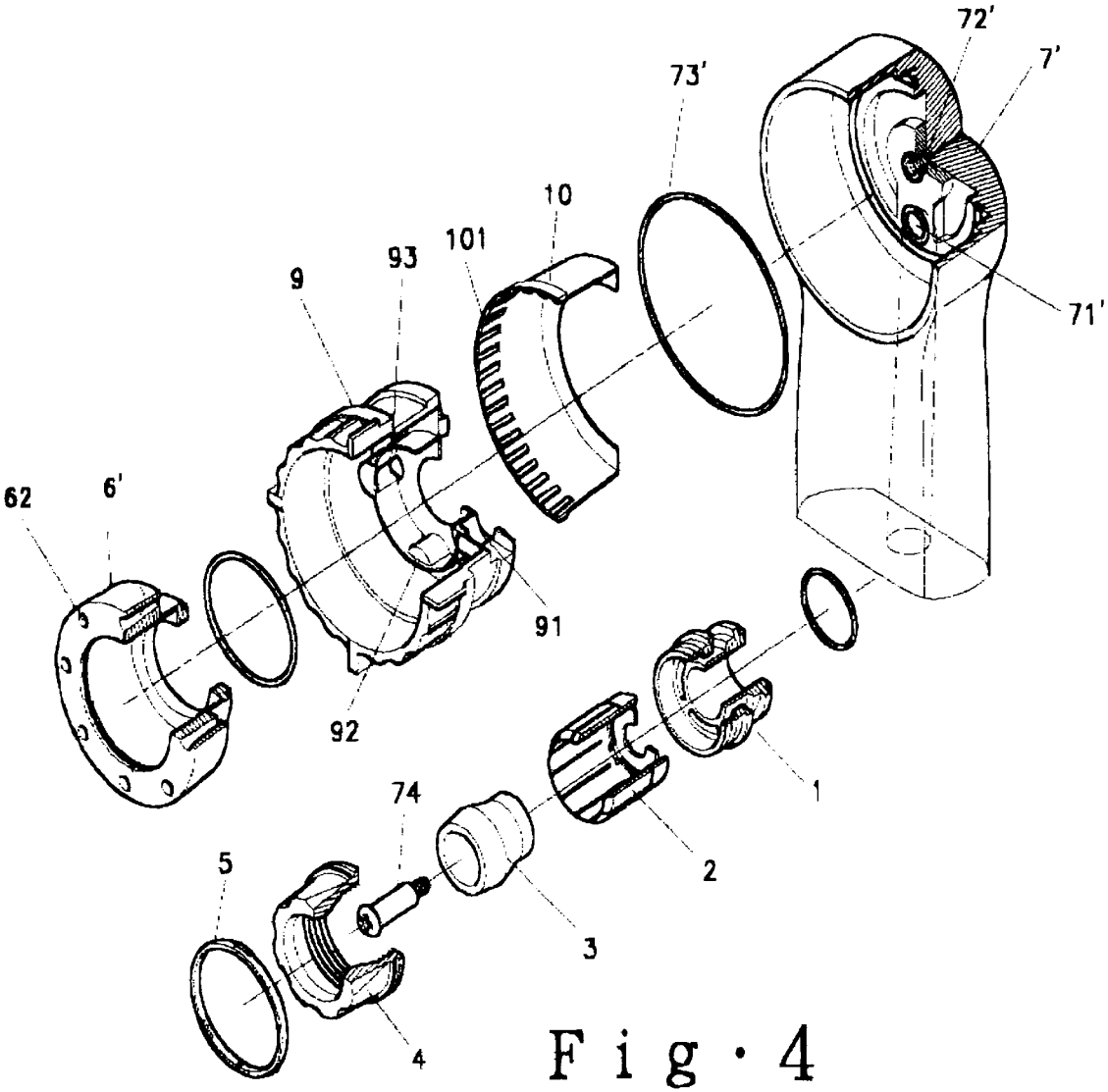
FIG. 4 is a perspective exploded view of a third preferred embodiment of the present invention.
Figure 4B:
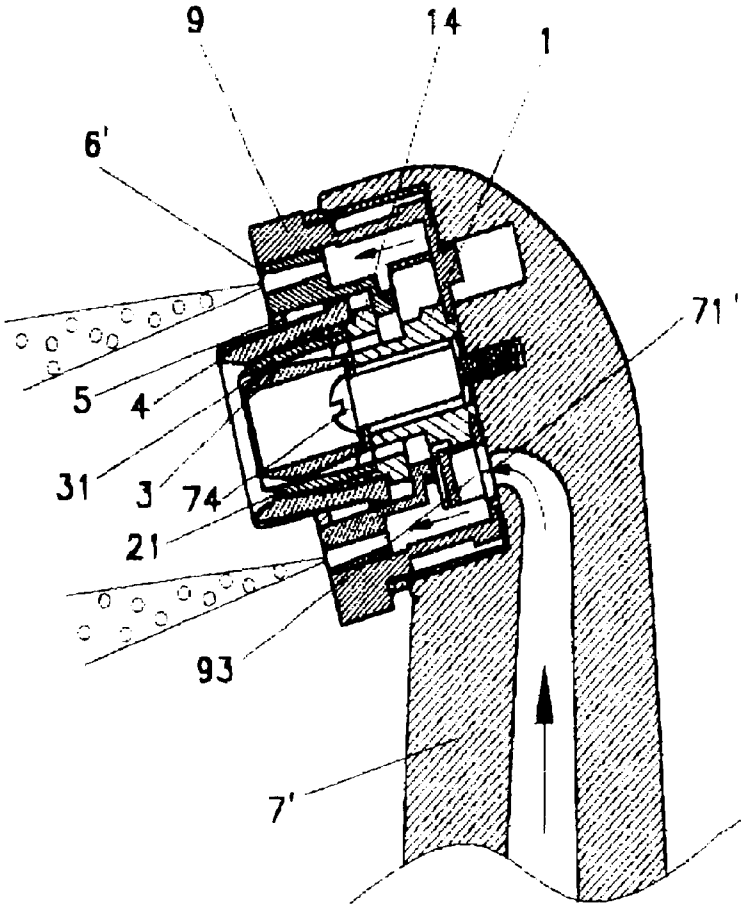
FIG. 4B is a second sectional view of the third preferred embodiment of the present invention showing the using state thereof.
Figure 4A:
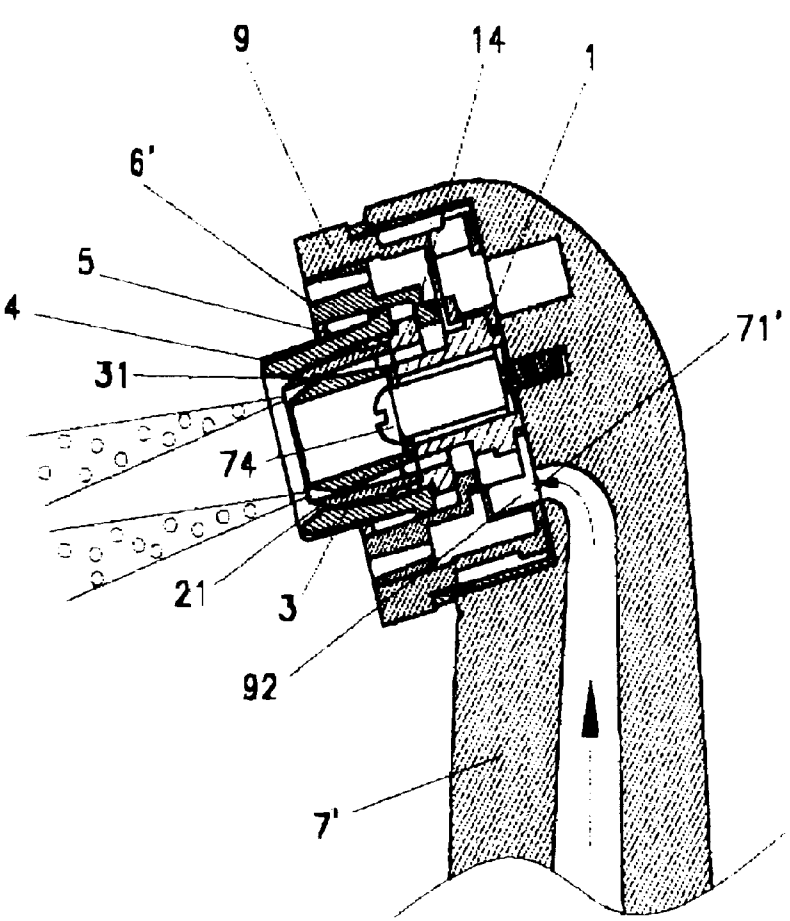
FIG. 4A is a first sectional view of the third preferred embodiment of the present invention showing the using state thereof.
Figure 4C:
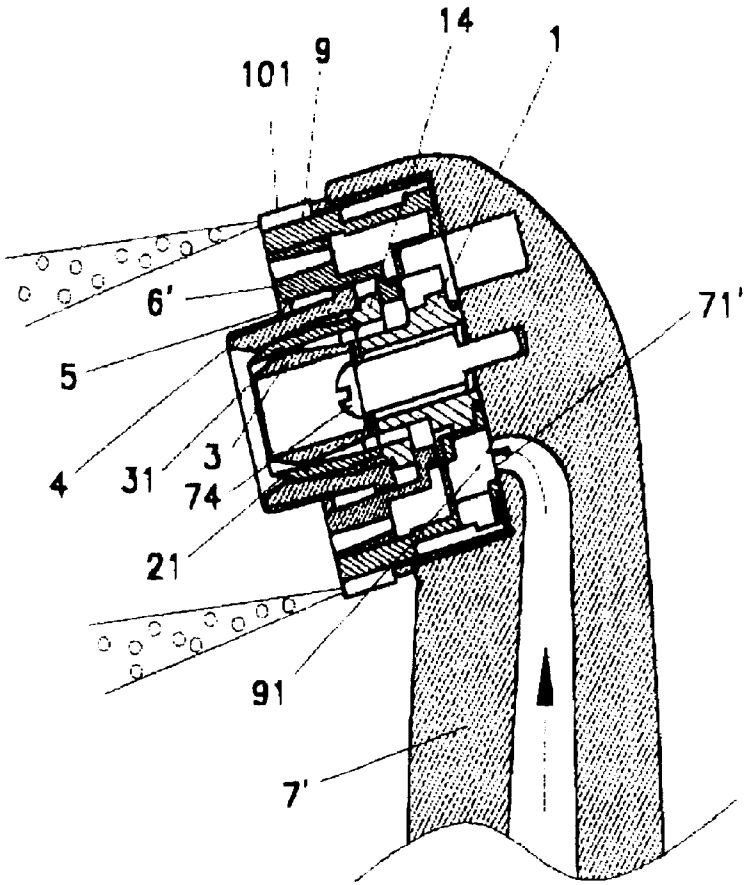
FIG. 4C is a third sectional view of the third preferred embodiment of the present invention showing the using state thereof.

FIG. 4 shows a perspective exploded view of a third preferred embodiment of the present invention. It's apparent from FIG. 4 together with FIGS. 4A, 4B and 4C, that the above-mentioned control device is joined with another inner sleeve 6', a switching seat 9 and a cap 10. The inner sleeve 6' is fitted with a spraying opening 62 while the switching seat 9 is provided with three different channels. In turning the switching seat 9, the water flowing from the opening 71' passes through the channels 93, 13, 22 to the clearance between the adjusting plates 21 and the push sleeve 3 for spraying outwards while a stepless adjustment can be reached (see FIG. 4A). Alternatively, the water flows through the channel 92 and sprays through the spraying opening 62 of the inner sleeve 6' (see FIG. 4B). In addition, the water can flow through the channel 91 to the spraying hole of the cap 10 for spraying outwards (FIG. 4C). Thus, a multiple change of the water flow is attainable.

Figure 5:
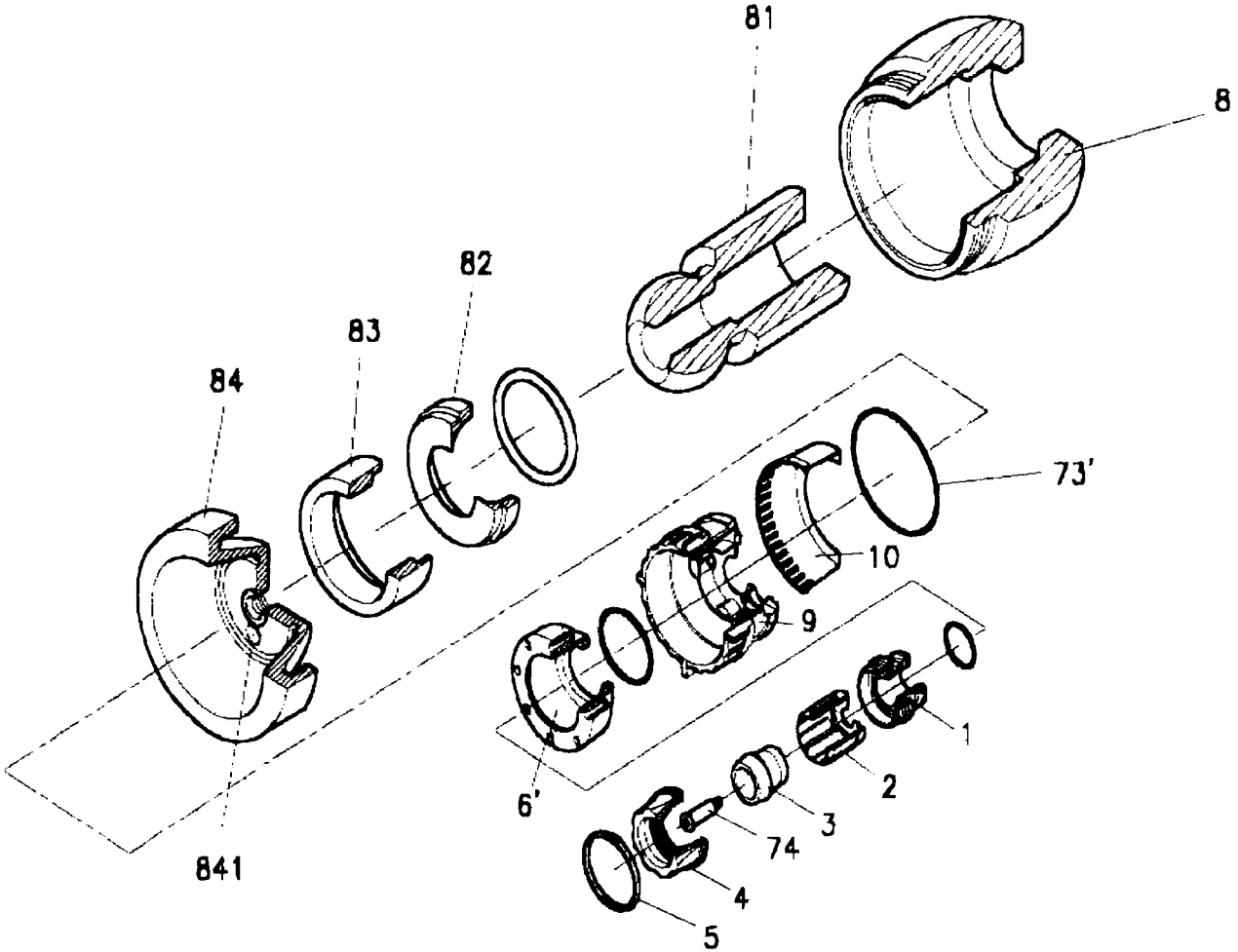
FIG. 5 is a perspective exploded view of a fourth preferred embodiment of the present invention.
Figure 5A:
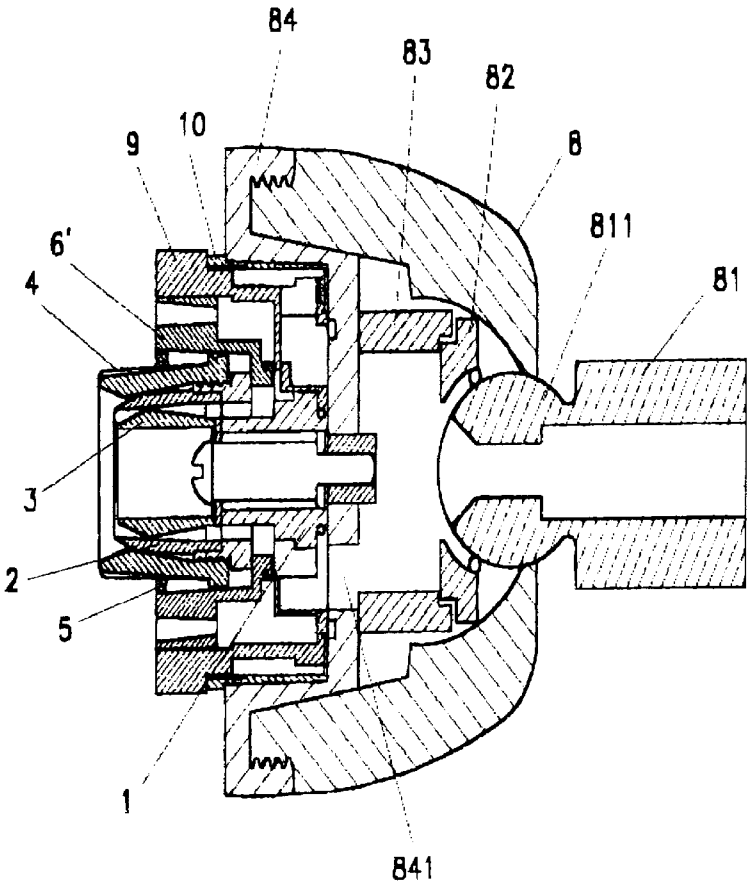
FIG. 5A is a sectional view of the fourth preferred embodiment of the present invention showing the using state thereof.

FIG. 5 shows a perspective exploded view of a fourth preferred embodiment of the present invention. It's apparent from FIG. 5 together with FIG. 5A that the above-mentioned three-step assembly and the said rotational device are combined for variable switching application. In turning the housing 8, different spraying directions is attainable; in turning the switching seat 9, different positions in spraying is achievable; and in turning the adjustment cap 4, a stepless spraying change of the water flow is reachable.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A continuously adjustable water flow control apparatus comprising:

a control seat having a male thread at one end thereof, a step rim at a center thereof and a partition inside thereof, a center of said partition including a first through hole at the step rim of which a plurality of first channels are disposed;

an adjustment head being cylinder-shaped, a side wall of an opening end thereof being comprised of adjusting plates arranged in a ring-shaped manner and evenly spaced, a bottom thereof including a second through hole and second channels that are aligned with the plurality of first channels of said control seat;

a push sleeve having a resilient ring positioned at a side wall thereof;

an adjustment cap having a slope at an inner rim thereof and a female thread at one end thereof;

said adjustment head is inserted into one end of said control seat such that said first and second channels are aligned, said push sleeve is installed in said adjusting plates of said adjustment head while said adjustment cap and said control seat are screwed together by said female thread and said male thread;

said adjustment cap is rotatively movable backwards and forwards at an outer rim of said control seat while said slope at an inner rim thereof is pushed against an outer rim of said adjusting plates, whereby a stepless change is created at a clearance between said adjusting plates and said push sleeve.

2. The continuously adjustable water flow control apparatus as claimed in claim 1, wherein the resilient ring is disposed at an outer rim of said push sleeve so that an inner rim of said adjusting plates is pressed against said resilient ring when said adjustment cap is rotated to push against said adjusting plates, thereby resulting in a finer sprayed water bloom.

3. The continuously adjustable water flow control apparatus as claimed in claim 1 or 2, further comprising an inner sleeve which is insertable into a shower head and fixed thereon by a screw on a fixing shaft hole of the shower head so that water can flow from an opening in the shower head, through the first and second channels to the clearance between said adjusting plates and said push sleeve for spraying outwardly and wherein, by turning said adjustment cap, a stepless control change of water flow is attainable since a sectional area of the outlet in spraying the water is variable.

4. The continuously adjustable water flow control apparatus as claimed in claim 1 or 2, wherein a rotational device secured with said control device comprises a housing, a rotational shaft, a joint seat, a push ring and a fixing seat, and wherein said rotational shaft is inserted into one end of said housing such that a ball seat is locked at the inner rim of said housing, thereafter said joint seat and said push ring are also installed while said fixing seat is screwed at the other end of said housing to create a multi-directional base, and wherein direction of water flowing out of said continuously adjustable water flow control apparatus is variable by turning said housing after said continuously adjustable water flow control apparatus is joined with an opening of said base while providing a stepless control of water flow.

5. The continuously adjustable water flow control apparatus as claimed in claim 1 or 2, wherein said continuously adjustable water flow control apparatus is joined with an inner sleeve, a switching seat, a cap and a shower head, and wherein said inner sleeve is fitted with a spraying opening while said switching seat is provided with three different channels, and wherein the water flows to the clearance between said adjusting plates and said push sleeve for spraying outward so that a stepless adjustment is attainable; alternatively, the water is able to spray through said spraying opening of said inner sleeve, and the water can spray through the spraying hole of said cap to create a multiple change of the water flow.

6. The continuously adjustable water flow control apparatus as claimed in claim 1 or 2, wherein said continuously adjustable water flow control apparatus is secured with a rotational device, said continuously adjustable water flow control apparatus comprises an inner sleeve, a switching seat, and a cap, and wherein said inner sleeve is fitted with a spraying opening while said switching seat is provided with three different channels, and wherein the direction of water flow is controllable by adjusting said housing of said rotational device, and wherein three different types of water flow is attainable by turning said switching seat, and wherein a stepless control of water flow is attainable by turning said cap.

* * * * *